US006457238B1

(12) United States Patent
Maier et al.

(10) Patent No.: US 6,457,238 B1
(45) Date of Patent: Oct. 1, 2002

(54) EATING UTENSIL

(75) Inventors: Michael Maier, Schwendistr. 20, 78098 Triberg (DE); Thomas Maier, Dorfstrasse 28, 78132 Niederwasser (DE); Thilo Schauer, Niedereschach (DE)

(73) Assignees: Michael Maier (DE); Thomas Maier (DE)

( * ) Notice: Subject to any disclaimer, the term of this patent is extended or adjusted under 35 U.S.C. 154(b) by 0 days.

(21) Appl. No.: 09/568,347

(22) Filed: May 10, 2000

(30) Foreign Application Priority Data

May 11, 1999 (DE) ..... 299 08 436 U

(51) Int. Cl.[7] ..... A47G 21/04

(52) U.S. Cl. ..... 30/142; 30/130; 30/135; 30/324; 294/50.8; D7/663; D7/664; D7/653

(58) Field of Search ..... 30/326, 324, 325, 30/327, 328, 142, 131, 134, 135, 124, 130; D7/653, 664, 662, 663; 7/158; 294/50.8

(56) References Cited

U.S. PATENT DOCUMENTS

| | | | | | |
|---|---|---|---|---|---|
| 75,139 | A | * | 3/1868 | Farrer | 30/326 |
| 233,185 | A | * | 10/1880 | Baker | 30/326 |
| 834,601 | A | * | 10/1906 | Woernle | 30/142 |
| 887,494 | A | * | 5/1908 | Mulertz | 30/135 |
| 1,980,477 | A | * | 11/1934 | Ertola et al. | 30/326 |
| 2,332,439 | A | * | 10/1943 | Cordwell | 30/131 |
| 2,887,948 | A | * | 5/1959 | Kramer et al. | 30/325 X |
| 3,727,306 | A | * | 4/1973 | Patik | 30/324 X |
| 4,521,964 | A | | 6/1985 | Maruyama | 30/148 |
| 4,610,086 | A | * | 9/1986 | Mastroianni | 30/135 |
| 4,984,367 | A | * | 1/1991 | Albanese | 30/324 X |
| 5,230,156 | A | * | 7/1993 | Patenaude | 30/325 |
| 5,419,049 | A | * | 5/1995 | MacArthur-Onslow | 30/322 |
| 5,554,161 | A | * | 9/1996 | Thibeault | 30/326 X |

FOREIGN PATENT DOCUMENTS

| | | | | |
|---|---|---|---|---|
| DE | 455286 | * | 1/1928 | 30/324 |
| DE | 27 49 685 A1 | | 5/1979 | |
| DE | 85 27 734.7 | | 1/1986 | |
| DE | 86 19 103.9 | | 10/1986 | |
| DE | 4040730 A1 | | 7/1992 | |
| EP | 0846532 A1 | | 7/1998 | |
| JP | 56-125010 | | 10/1981 | |

* cited by examiner

*Primary Examiner*—Charles Goodman
(74) *Attorney, Agent, or Firm*—McGlew and Tuttle, P.C.

(57) ABSTRACT

An eating utensil with a spoon shell fastened to a handle enables handicapped people, who have, e.g., only one usable hand, to reduce in size pieces of food, e.g., meat, by cutting into bite-sized pieces. To achieve this, the spoon shell (1, 31) and the handle (6) are of a two-part design. The spoon shell (1) has a first shell part (2) with a first handle shaft (4) and a second shell part (3) with a second handle shaft (5). The respective shell parts (2, 3) and handle shafts (4, 5), which are rigidly connected to one another, are connected to one another by a scissor hinge (7) and can be moved against one another in a scissor-like manner. The shell parts (2, 3) have cutting edges (8, 9) cooperating in a scissor-like manner.

11 Claims, 9 Drawing Sheets

Fig.5a
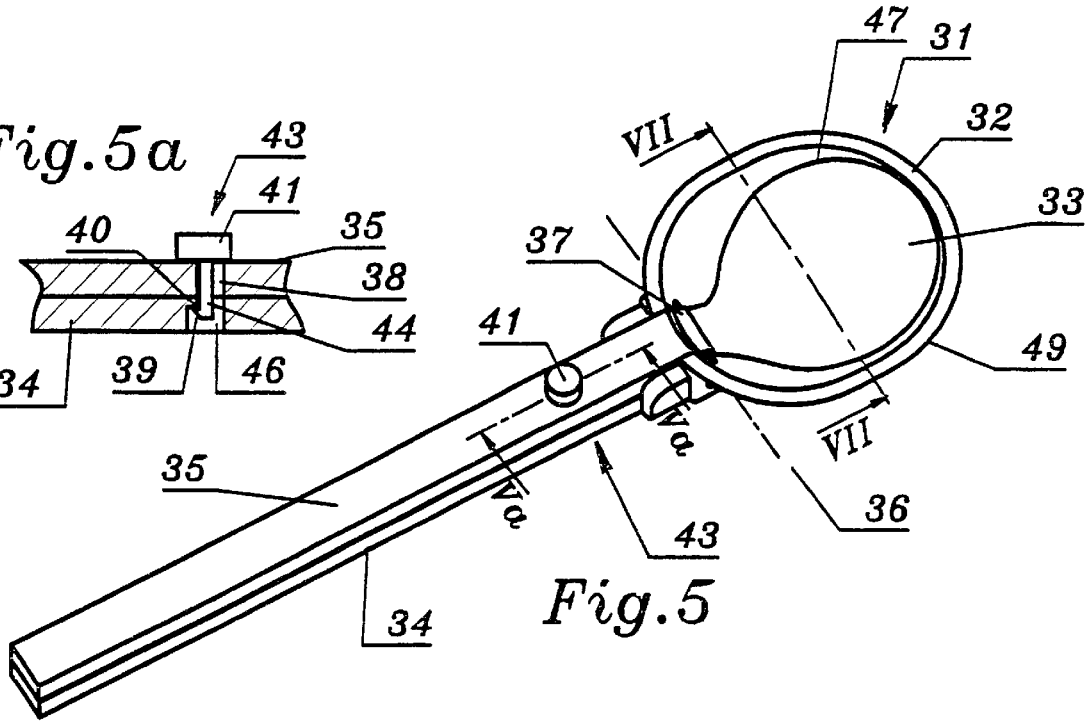
Fig.5
Fig.6a
Fig.6
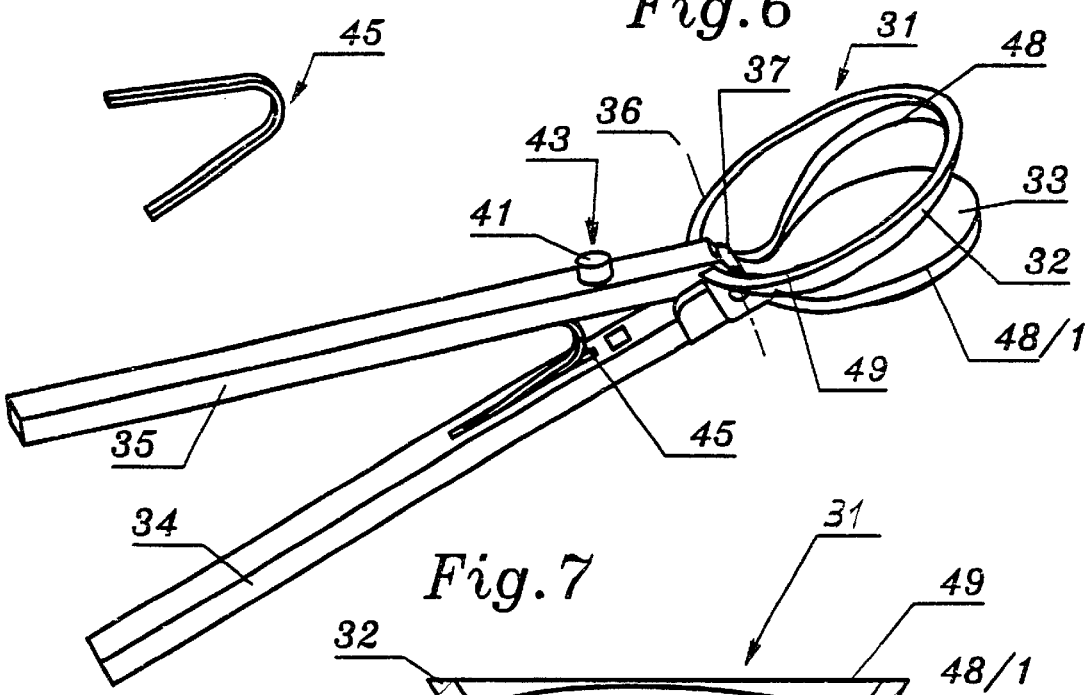
Fig.7
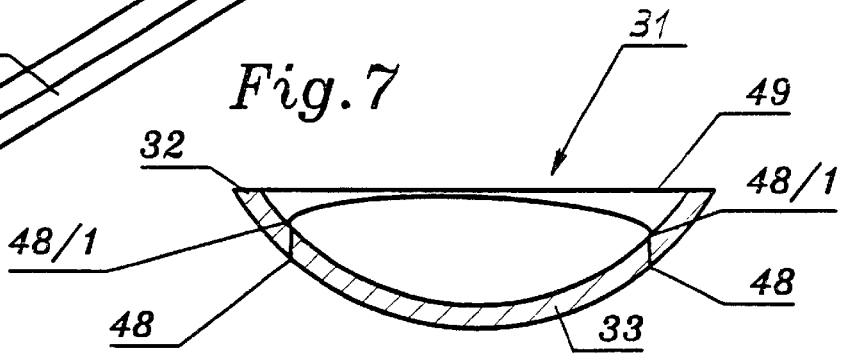

52/1
37
47
31
53/1
32
33

EATING UTENSIL

FIELD OF THE INVENTION

The present invention pertains to an eating utensil with a spoon shell fastened to a handle.

BACKGROUND OF THE INVENTION

Eating utensils of this type have been known for a long time. Those with a handle and with a spoon shell fastened thereto are used especially in the form of a soup spoon for eating liquid or small particulate food. The drawback of these prior-art eating utensils is that larger pieces of food, e.g., pieces of meat, cannot be reduced in size with the spoon shell. Even if such reduction in size is possible in the case of relatively soft pieces of food, a second eating utensil, e.g., in the form of a fork, is needed to hold this piece of food during division. Dividing such a food with a conventional soup spoon is thus possible with difficulty only, especially with one hand, so that especially handicapped people with only one usable hand are usually dependent on the assistance of a second person to reduce in size pieces of food.

Various eating utensils with multiple functions to enable such persons to reduce in size pieces of food independently have become known.

For example, an eating utensil that can be used with one hand for one-armed and handicapped people (DE 86 19 103.9 U1) has been known, which has a fork and a knife arranged on one side of the fork, which said knife is displaceable in the longitudinal direction of the fork and is mounted tiltably around an axis extending approximately at right angles to the edge of the knife against spring pressure by loading the back of the knife. The knife and the fork are mounted in a common, grip-like sheath. The fork can be turned around between a folded-out position projecting from the sheath in the longitudinal direction of the sheath and a folded-in position located adjacent to the outside of the sheath, while the knife is displaceable between an extended position in which it is extended from the sheath and a withdrawn position in which it is withdrawn into the sheath, and it is accommodated in the sheath. This fork and knife combination shall enable handicapped persons to independently reduce in size a piece of food locked with the fork by extending the blade of the knife and a relative movement. This means that the user must displace the blade of the knife in the axial direction and must also perform the tilting movement simultaneously by pressing the back of the knife, e.g., with a finger. This type of use is extremely complicated and is consequently suitable for the one-hand operation of the fork and knife combination only conditionally.

A fork-and-knife eating utensil for one-handed people, in which a fork body is arranged on a handle, has likewise been known from DE 27 49 685 A1. An axially movable knife body of an approximately U-shaped design, whose fork-side front edge is designed as a knife blade, is arranged on this handle. A piece of food, which is held by means of the fork body, shall be "punched out" by the forward movement of the knife body by means of this eating utensil. The handling of this prior-art eating utensil is also extremely difficult, because, especially in order to ensure the complete cutting through of the piece of food, the handle must be held with the knife body at right angles to the support so that the knife body can indeed cut the piece of food completely with its blade. Since the knife body has an essentially U-shaped design, this eating utensil must be brought into contact with the food, tuned at least twice by 180°, to completely separate a piece of food, so that complete cutting through is extremely complicated.

In another eating utensil for the handicapped (DE 85 27 734.7 U1), a fork, with which a cutting device is associated, is likewise provided on a grip part. The cutting device has a knife arranged in the area of the prongs of the fork with a blade extending at right angles to the prongs of the fork, wherein the said knife is longitudinally displaceable in the direction of the prongs of the fork and is mounted pivotably. To facilitate the cutting movement proper, an electric motor, which mediates a cutting pivoting movement to the knife via a gear mechanism, is also provided in the housing. Thus, a piece of food picked up by the fork can be cut through by means of this eating utensil at least on one side by the axial displacement of the knife and the simultaneously active electric motor. However, depending on the shape of the piece of food, this eating utensil must be brought into contact with the piece of food several times in order to perform a complete separation. Furthermore, energy supply is always necessary for the electric motor in this eating utensil, which has the disadvantage, especially in the case of a battery-operated eating utensil, that replacement batteries must always be present in order to maintain the ability of this eating utensil to function and that the batteries increase the weight and make the eating utensil bulky.

SUMMARY AND OBJECTS OF THE INVENTION

The primary object of the present invention is to design an eating utensil with a spoon shell fastened to a handle such that it can be used with one hand and that a cutting function can also be performed with it in a simple manner to reduce in size pieces of food.

According to the present invention a spoon shell and the handle being designed as two-part pieces and by a first spoon shell part and a second spoon shell part and forming a first handle shaft and a second handle shaft, respectively, and by the first spoon shell part being rigidly connected to the first handle shaft and by the second spoon shell part being rigidly connected to the second handle shaft, and by the handle shafts being connected to one another by a scissor hinge and being movable against one another in a scissor-like manner, and by the two spoon shell parts having cutting edges cooperating in a scissor-like manner.

The design according to the present invention makes available an eating utensil with which the functions of division, picking up of the food and moving it to the mouth can be performed by handicapped people in a simple and reliable manner. Using the eating utensil according to the present invention, a handicapped person can thus reduce in size pieces of food and eat them independently with one hand only. The scissor-like movement of the two spoon shell parts makes available an extremely simple cutting method, in which it is not necessary to fix the piece of food by means of a second utensil in any way. The design of the eating utensil according to the present invention thus corresponds approximately to a pair of scissors, whose scissor blades are designed as spoon shell parts.

Due to the scissor hinge being arranged in the vicinity of the edge of the spoon shell it is possible to apply extremely strong shearing forces or cutting forces during the reduction in size of pieces of food, which makes the eating utensil according to the present invention particularly suitable even for people, e.g., handicapped children, who do not have a correspondingly strong force in their hand.

Handiness is further improved by the spreading spring provided, by which the two handle shafts and spoon shell parts can be spread apart. The arrangement of the spreading spring between the two handle shafts makes possible the extremely simple assembly as well as variable design of the spreading spring.

Due to the spoon shell being divided lengthwise approximately in the middle, the eating utensil according to the present invention can also be used in a simple manner as a gripping tong, as a result of which its user-friendliness is considerably improved and its applicability is expanded.

As an alternative, the spoon shell may also be divided along a ring line, so that an edge ring closed in itself is created with the first handle shaft and an inner shell part is connected to the second handle shaft. Due to this embodiment, the cutting edge proper is located during the reduction in size of a piece of food essentially in a plane extending in parallel to the edge of the spoon, so that while the spoon shell is closed in a scissor-like manner and is held horizontally, the piece of food cut off automatically comes to lie on the spoon and can be moved immediately to the mouth. An extremely simple and easily handling is achieved due to this embodiment as well.

Due to the ability of the spoon shell parts to be locked in their closed position by means of a securing element arranged on a handle shaft, the eating utensil according to the present invention can be safely used as a conventional one-part soup spoon with the spoon shell parts locked. Advantageous embodiments of a locking means are also disclosed.

Due to the replaceable arrangement of the handle shafts at the spoon shells, the eating utensil according to the present invention can be adapted to the individual needs of a handicapped person in a simple manner. Thus, handle shafts of different shapes and sizes can be connected to the spoon shell parts, so that the eating utensil according to the present invention can be selected optimally in a simple manner, e.g., depending on the size of the hand or the nature of the handicap of the person using it.

The cutting edge of one spoon shell part may be provided with a sealing strip extending under the cutting edge of the other spoon shell part, so that the eating utensil according to the present invention can also be used to take up liquid foods, e.g., a soup.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 5 is a perspective view of an eating utensil of the type according to the present invention with a spoon shell divided in another manner in the closed state;

FIG. 5*a* is a sectional view along line Va—Va from FIG. 5;

FIG. 6 is a perspective view of the eating utensil according to FIG. 5 in the opened FIG. 6*a* is a perspective view of the spreading spring as an individual part;

FIG. 7 is a sectional view along line VII—VII from FIG. 5;

DESCRIPTION OF THE PREFERRED EMBODIMENT

Figure 1:
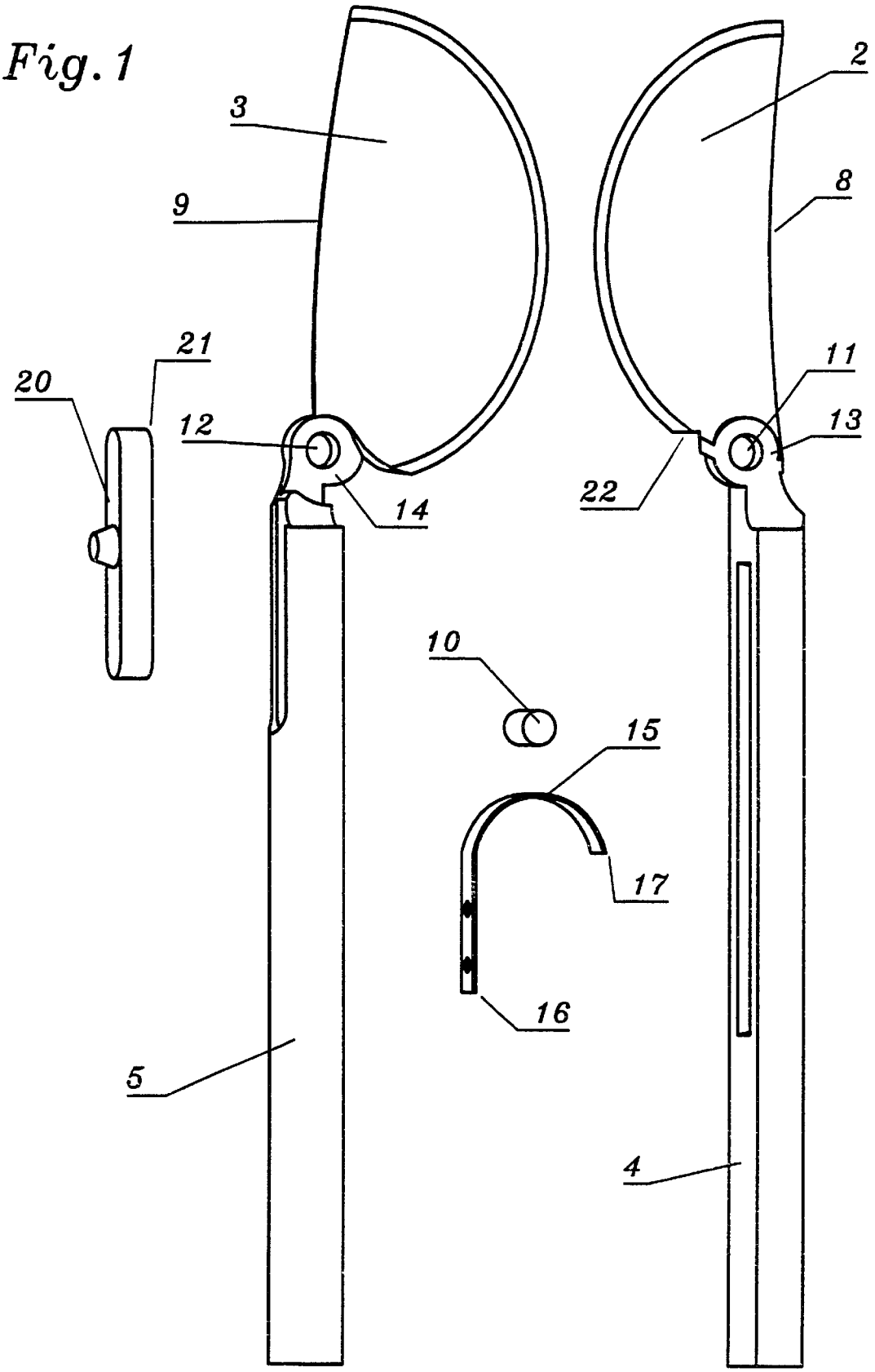
FIG. 1 is a perspective exploded view of an eating utensil according to the present invention.

Referring to the drawings in particular, the eating utensil shown in FIGS. 1 through 4 has a spoon shell 1 divided into two in the longitudinal direction. The two shell parts 2 and 3 are made in one piece each and are rigidly provided with a respective handle shaft 4 and 5. In the closed state of the eating utensil shown in FIG. 3, these two handle shafts 4 and 5 form a spoon handle 6 and the two shell parts 2 and 3 form the closed spoon shell 1.

In the vicinity of the edge of the spoon shell 1, the two handle shafts 4 and 5 are connected to one another by a scissor hinge 7 and thus they can be moved against one another in a scissor-like manner.

Figure 4:
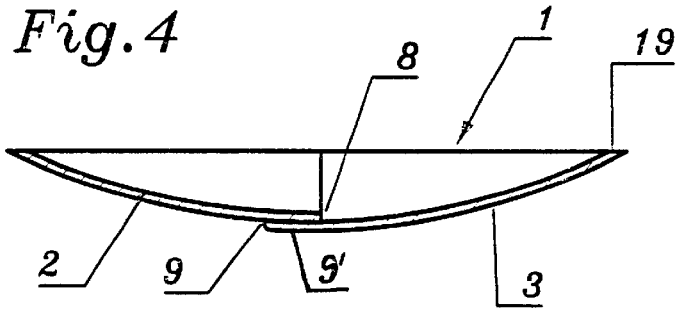
FIG. 4 is a sectional view along line IV—IV from FIG. 3.

To be able to be used as a scissor-like cutting tool in the opened state, the two shell parts 2 and 3 are provided with respective cutting edges 8 and 9, which cooperate in a scissor-like manner and mutually extend under one another in the closed state of the spoon shell 1, as is shown in FIG. 4, so that liquid food can also be moved to the mouth with this spoon shell 1 or with this eating utensil in the closed state.

It may also be expedient to provide the cutting edge 9 extending under the other with a sealing strip 9'.

The scissor hinge 7 comprises two bearing bores 11 and 12, which are arranged in respective bearing eyes 13 and 14 made in one piece with them and are connected to one another in the coaxial position by a common cylindrical bearing bolt 10.

A spreading spring 15, which is bent in the shape of a U, consists of a flat strip material, is fastened with an extended shaft part 16 to the handle shaft 4 on the inside, and is supported with the bent end section 17 on the inside of the opposite handle shaft 5, is arranged between the two handle shafts 4 and 5.

This spreading spring 15 has the task of pushing the two handle shafts apart and of holding the two handle parts 2 and 3 in the opened state so that when this eating utensil is being used as a cutting tool, only the closing and thus the cutting movement must be brought about by manual force.

Figure 3:
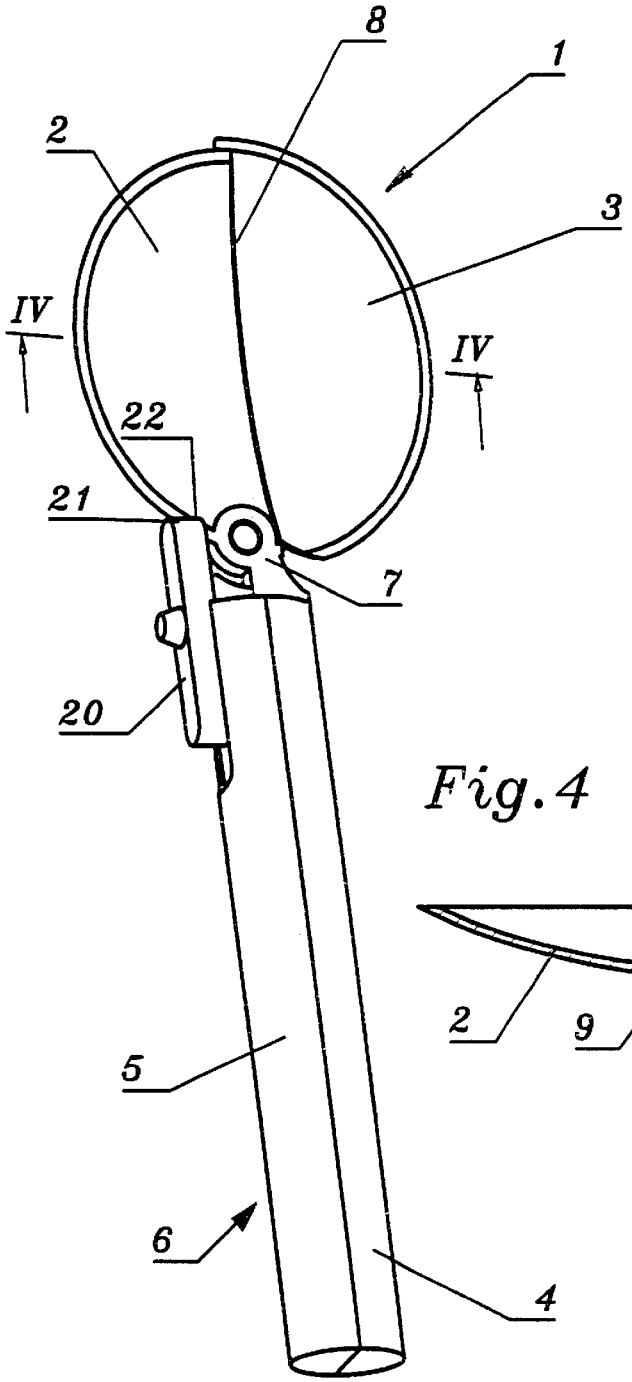
FIG. 3 is a perspective view showing the eating utensil according to FIG. 2 in the closed state.

To hold the two shell parts 2 and 3 as well as the handle parts 4 and 5 in the closed state shown in FIG. 3 as needed, the handle shaft 5 is provided with a displaceable locking bar 20, which extends with a locking nose 21 into the range of pivoting of a locking edge 22 of the shell part 2 when it is in the locked position shown in FIG. 3.

Figure 2:
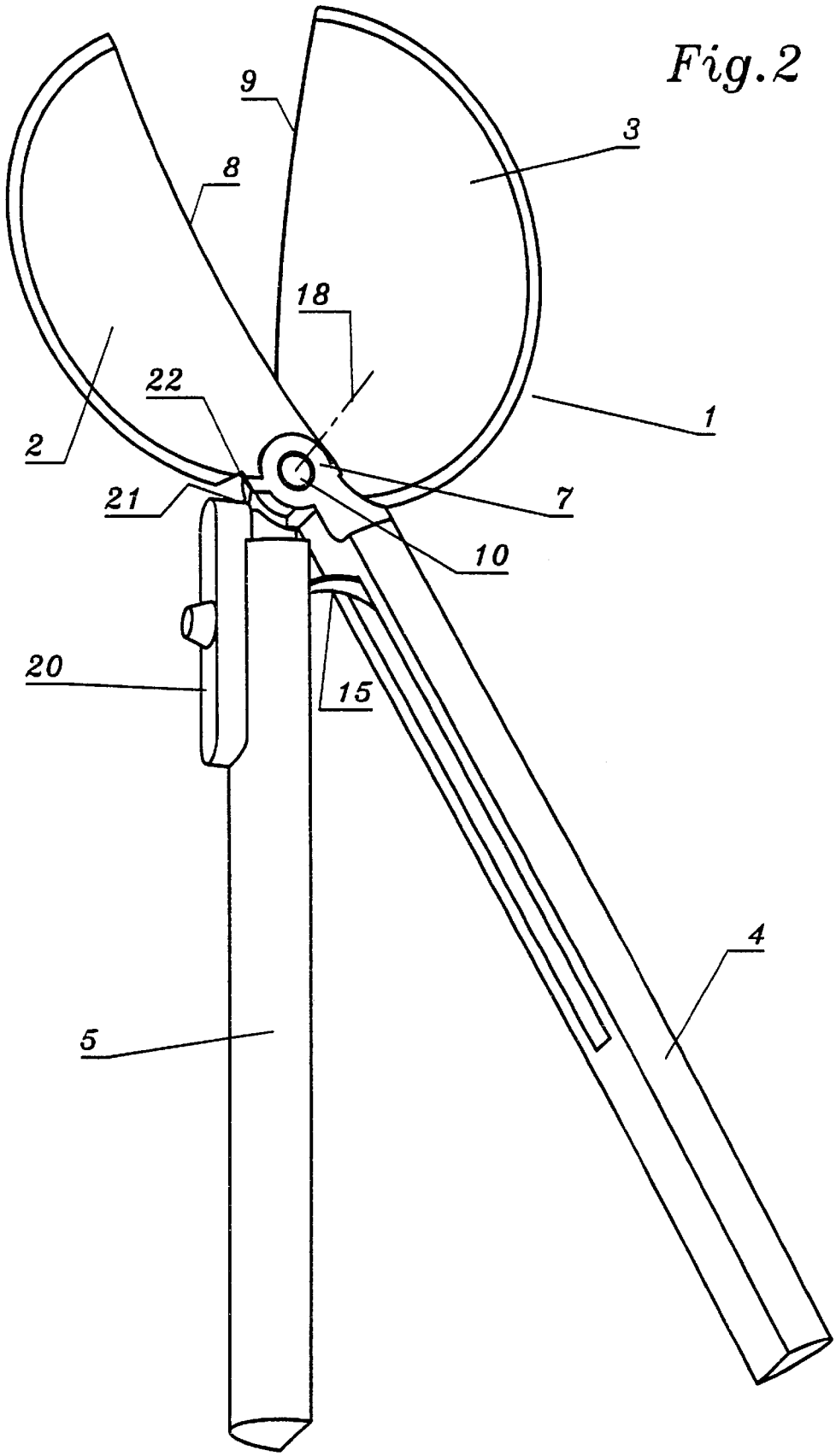
FIG. 2 is a perspective view showing the components from FIG. 1 in the assembled state.

In FIG. 2, in which both the shell parts 2 and 3 and the handle shafts 4 and 5 are shown in the opened spread-apart position, the locking bar 20 is in its ineffective position, in which it is away from the locking edge 22, so that the locking nose 21 cannot cooperate with the locking edge 22.

This possibility of locking is necessary to lock the spoon shell 1 in the closed state when the eating utensil is used as a spoon only.

A two-part spoon shell 31 is also present in the eating utensils shown in FIGS. 5 through 16, inclusive, but this spoon shell is not divided longitudinally in the middle, as the spoon shell 1, but along a ring line 47, such that an edge ring 32 that is closed in itself and an inner shell part 33 are formed.

The edge ring 32 is made in one piece with and rigidly connected to a handle shaft 34, and the shell part 33 is likewise made in one piece with and rigidly connected to a handle shaft 35.

The two handle shafts 34, 35 are connected to one another by a scissor hinge 37 located in the vicinity of the edge of the spoon shell 31 and can be moved in a scissor-like manner against one another as a result. To make it possible to use these two components of the spoon shell 31 as a scissor-like cutting tool as well, both the edge ring 32 and the shell part 33 are provided with a respective cutting edge 48 and 48/1, which cooperate in a scissor-like manner in order to reduce in size food, e.g., pieces of meat, vegetable parts, desserts, etc., located between them while pressing together the handle shafts 34 and 35, which can be spread by a spreading spring 45.

In this case as well, the spreading spring 45 comprises a U-shaped strap, which is arranged between the two handle shafts 34 and 35 to exert a spreading action.

While the pivot axis 18 of the scissor hinge 7 extends at right angles to the plane of the spoon shell edge 19 in the eating utensil according to FIGS. 1 through 4, the pivot axis 36 of the scissor hinge 37 extends in parallel to the plane of the spoon shell edge 49 and at right angles to the longitudinal direction of the two handle shafts 34 and 35 in the eating utensil according to FIGS. 5 and 6.

To make it possible to lock the two spoon shell parts 32 and 33 in a closed position in this eating utensil as welt as is shown in FIGS. 5 and 7, a locking device 43 is provided here as well. This locking device comprises a locking pin 44, which is mounted displaceably in the longitudinal direction of the handle shaft 35 in an elongated hole 38 of this handle shaft 35 and is provided with a locking nose 39, which lockingly extends behind a locking shoulder 40 of a recess 46 of the opposite handle shaft 34 when it assumes the locked position shown in FIG. 5*a*.

The locking pin 44 can be displaced in the elongated hole 38 by means of an actuating knob 41 to the extent that the locking nose 39 leaves the locking shoulder 40 and the two handle shafts 34 and 35 can be spread apart, as is shown in FIG. 6.

The displacement of the locking pin 44 from the released position and into the locked position shown in FIG. 5 and vice versa is always to be performed manually, e.g., with the thumb or another suitable finger.

As is apparent from FIG. 5, the two hinge parts, namely, the edge ring 32 and the shell part 33, form a closed spoon shell 31 in the closed state, which can be readily used as a normal spoon for eating liquid meals from a bowl or another container.

Figure 8:
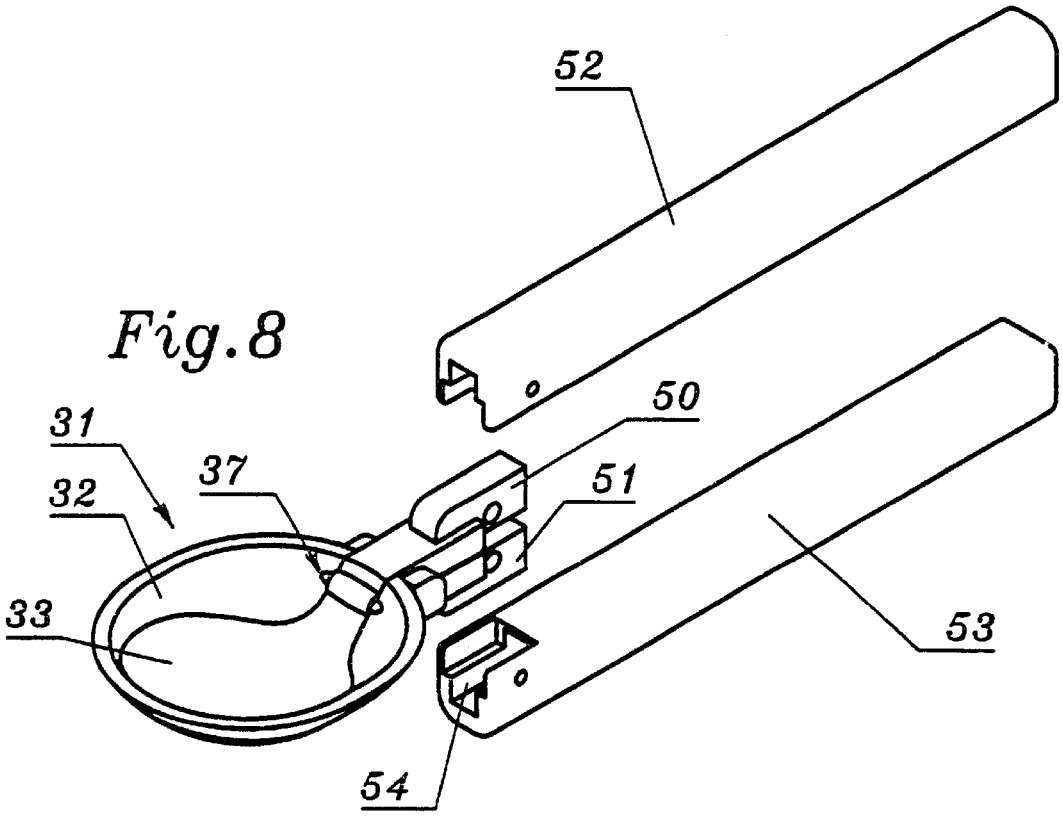
FIG. 8 is a perspective view of an eating utensil with a spoon shell divided according to FIGS. 5 and 6 in the closed state with two replaceable handle shafts.

In the embodiment according to FIG. 8, the two parts of the spoon shell 31, namely, the edge ring 32 and the shell part 33, are provided in one piece each with shaft stumps 50 and 51, to which straight or bent handle shafts 52 and 53 of different designs can be optionally fastened replaceably.

Figure 9:
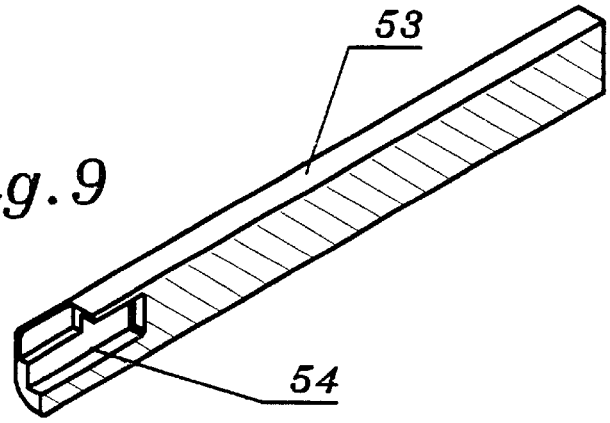
FIG. 9 is a partially sectional perspective view of the handle shaft from FIG. 8, which is cut in the longitudinal direction.

The sectional view of such a replaceable handle shaft 53 is shown in FIG. 9. A recess 54, which is used to receive the shaft stump 51, is recognized at its front end. Cross pins, not shown, which can be easily detached and fixed, may be provided to fix the two handle shafts 52 and 53 to the respective shaft stumps 50 and 51.

Figure 12:
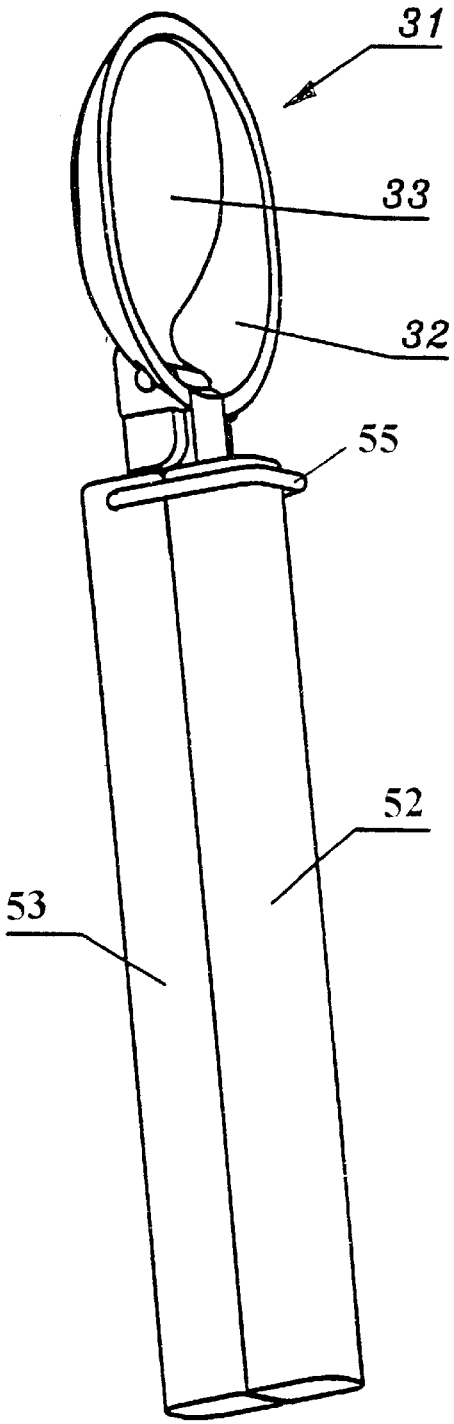
FIG. 12 is a perspective view of an eating utensil according to FIG. 8 in the closed state with a locking clamp.
Figure 13:
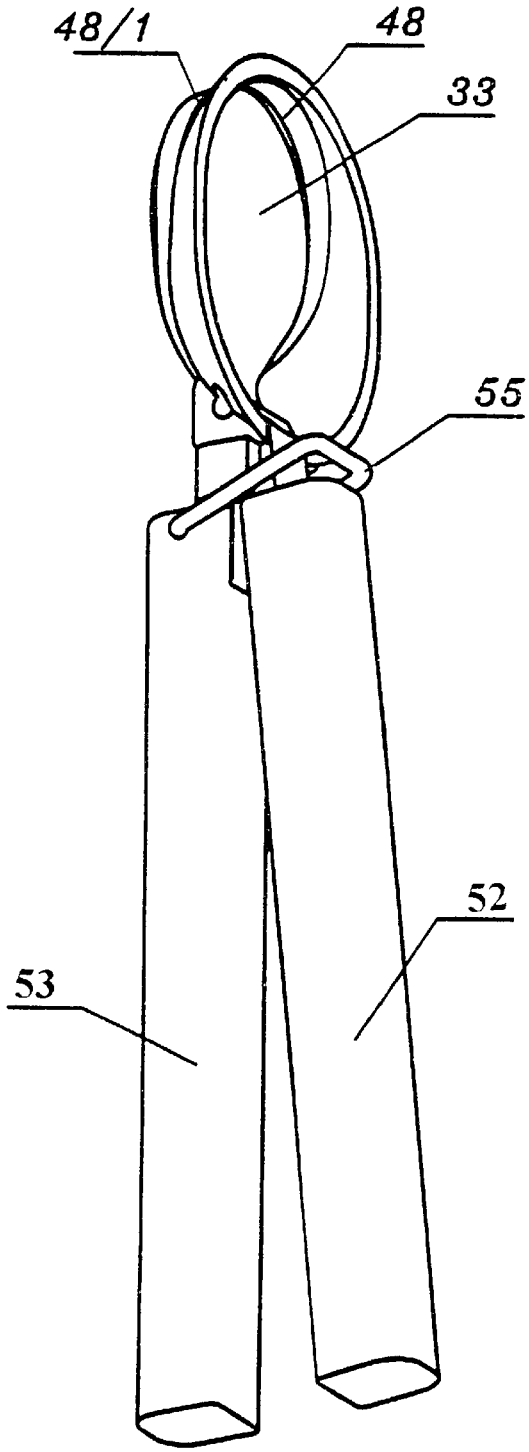
FIG. 13 is a perspective view of the eating utensil according to FIG. 12 in the opened state.

The eating utensil shown in FIGS. 12 and 13 differs from that according to FIGS. 5 and 6 only in that a different locking device is provided. This locking device comprises a U-shaped wire clip 55, which is pivotably fastened to the front end of the handle shaft 34 and, as is shown in FIG. 12, can be pivoted over the front end of the handle shaft 35 in order to prevent it from performing a spreading movement, which is brought about by a spreading spring in this case as well.

Figure 10:
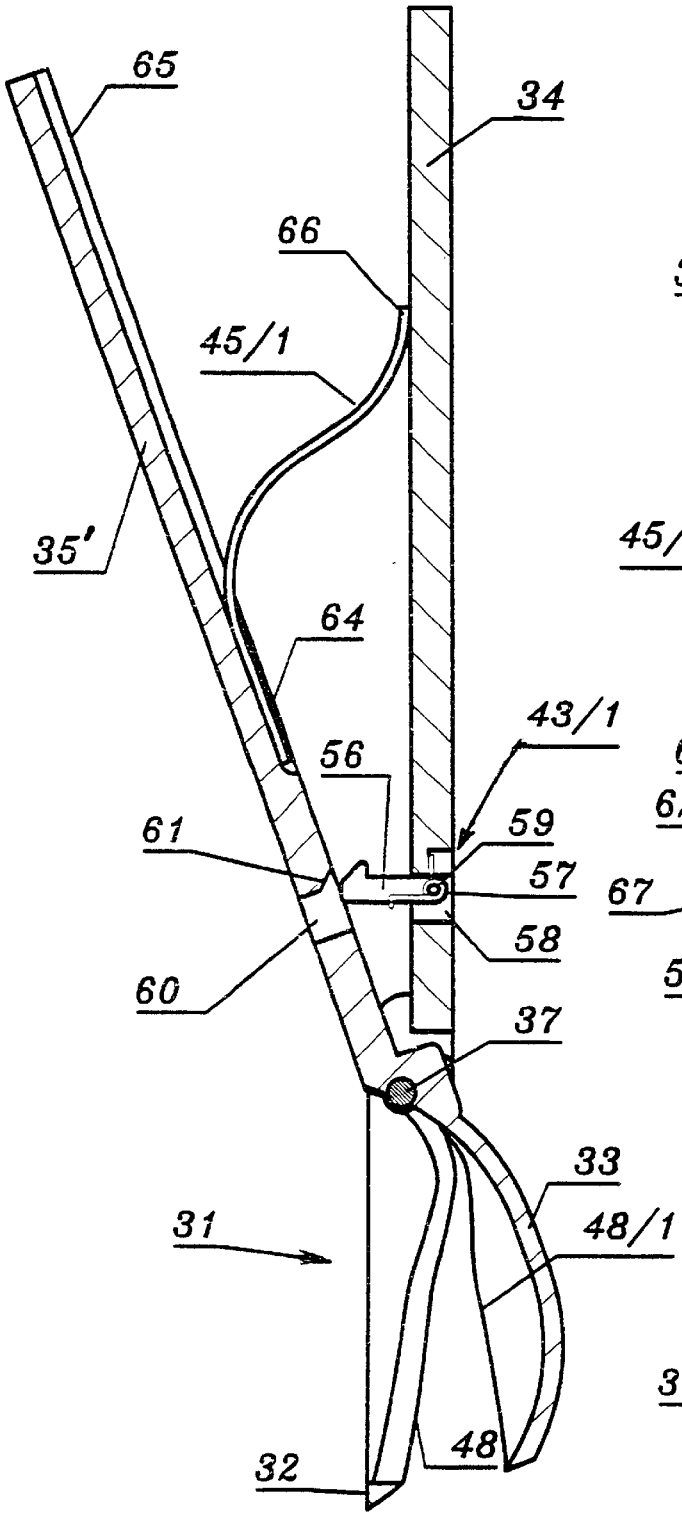
FIG. 10 is a longitudinally cut representation of an eating utensil according to FIG. 6 with another spreading spring and another locking device in the opened state.
Figure 11:
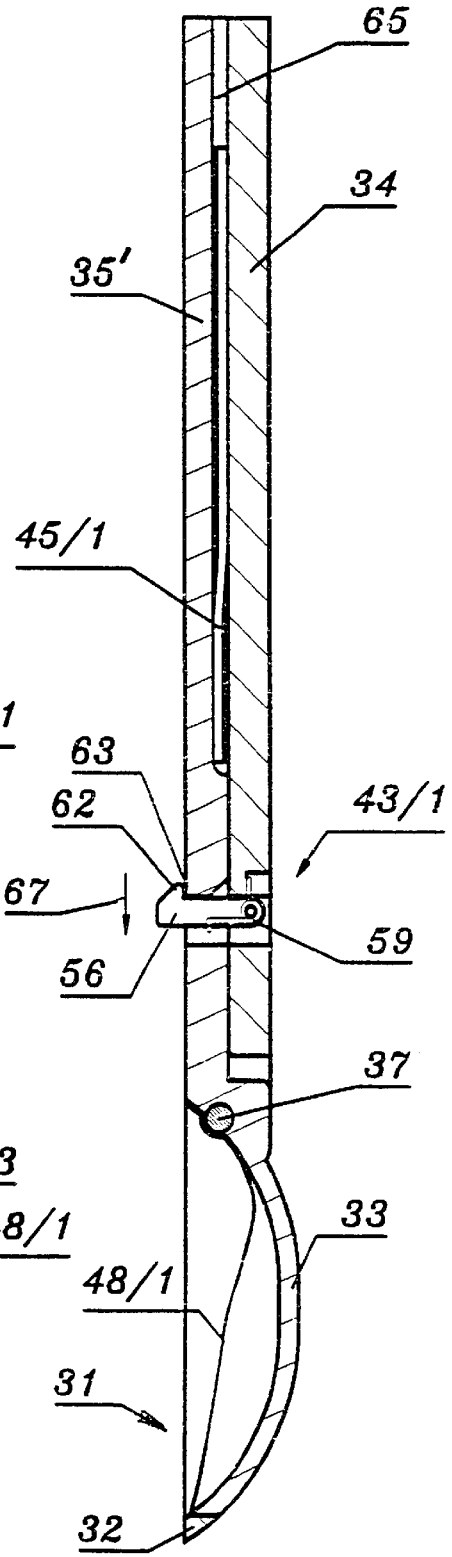
FIG. 11 is a longitudinally cut representation of the eating utensil according to FIG. 10 in the closed state.

FIGS. 10 and 11 show an eating utensil cut in the longitudinal direction, which corresponds essentially to the eating utensil according to FIGS. 5 and 6 in the opened and closed states.

While the spoon shell 31 has a completely identical design as in the eating utensil according to FIGS. 5 and 6, the eating utensil according to FIGS. 10 and 11 has a different locking device 43/1 as well as a spreading spring 45/1 of a different design.

The locking device 43/1 comprises a pivotable detent pawl 56, which is mounted pivotably on a bearing journal 57 in a recess 58 of the handle shaft 34 and is under the effect of a torsion spring 59. To receive the detent pawl 56, a handle shaft 35' is likewise provided with a recess 60, which has an oblique deflecting surface 61 for the detent pawl 56 on the inside.

In the closed state according to FIG. 11, the detent pawl 56 with its locking nose 62 extends over the outer edge 63 of the recess 60 of the handle shaft 35, so that the two handle shafts 34 and 35 are held together and the spoon shell 31 is held in the closed state.

To release the locking device 43/1, the detent pawl 56 is pivoted against the action of the torsion spring 59 in the direction of arrow 67 in order to release the handle shaft 35, so that the spreading finger 45/1 can open the eating utensil in a scissor-like manner in the manner shown in FIG. 10.

The spreading spring 45/1 provided here comprises a spring steel strip bent essentially in the shape of an S, which is fastened with one end 64 in an inner longitudinal groove 65 of the handle shaft 35 and is loosely in contact with its other end 66 with the inside of the handle shaft 34, i.e., displaceably in the longitudinal direction.

Figure 14:
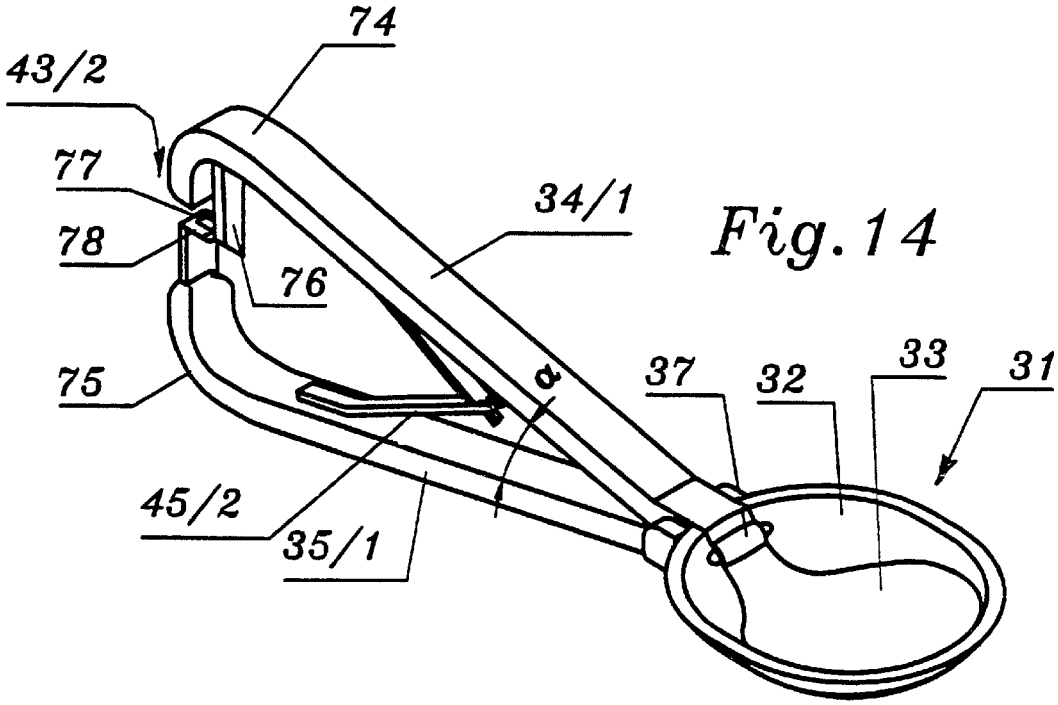
FIG. 14 is a perspective view of an eating utensil with a spoon shell divided according to FIGS. 5 and 6 with the handle shafts, which are spread even in the closed state of the spoon.
Figure 15:
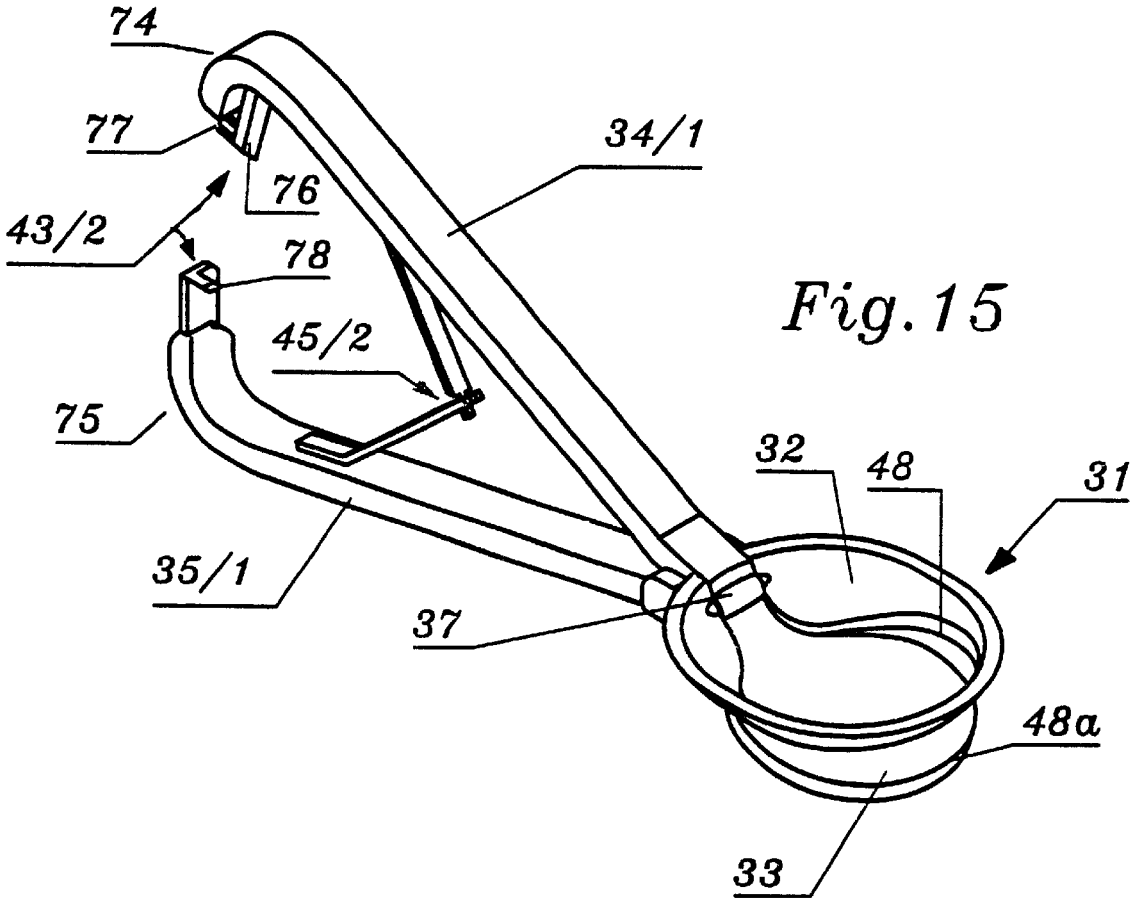
FIG. 15 is a perspective view of the eating utensil according to FIG. 14 in the opened state.

In the embodiment according to FIGS. 14 and 15, the edge ring 32 and the shell part 33 of the spoon shell 31 are provided with respective handle shafts 34/1 and 35/1, which form an acute angle a of about 15° to 20° with one another even in the closed state of the spoon shell 31 (see FIG. 14), so that their two end sections 74 and 75 bent against one another are located at a greater distance from one another than the straight handle shafts 34 and 35 of the embodiments described before, which are located close by to one another in the closed state. A spreading ring 45/2, which is a two-part spring in this case, is also arranged between these handle shafts 34/1 and 35/1 for an independent opening of the spoon shell 31.

Due to this greater distance, it is easier for the operator or user to exert a stronger manual closing force on the two handle shafts 34/1 and 35/1 and consequently also on the cutting edges 48 and 48*a* of the spoon shell 31.

To make it possible to lock the spoon shell 31 in the closed state in this embodiment as well, the bent end sections 74 and 75 of the two handle shafts 34/1 and 35/1 are provided with a locking device 43/2.

This comprises essentially a detent pawl 76, which is arranged on the end section 74 and with a locking nose 77, it can be brought into locking engagement with a ratchet 78 of the opposite end section 75 of the handle shaft 35/1, as is shown in FIG. 14.

By pressing the two handle shafts 34/1 and 35/1 together more, this locking connection can be released in order for the spreading spring 45/2 to be able to open the spoon shell 31, as is shown in FIG. 15.

With such a prior-art locking device 43/2, this eating utensil can be used in a very simple manner both to cut and to reduce in size foods and to bring this cut food or other foods to the mouth with the closed spoon shell 31.

Figure 16:
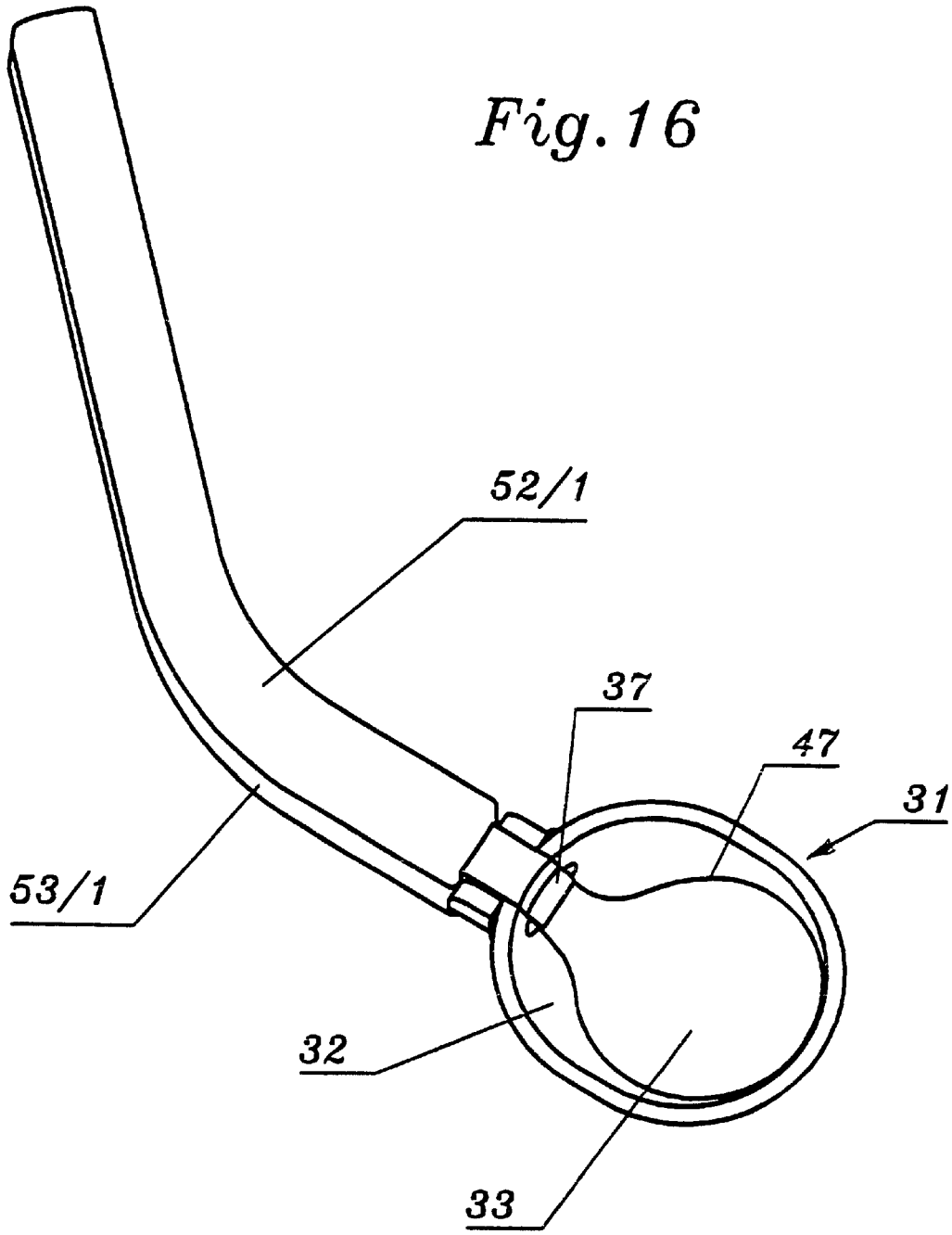
FIG. 16 is a view of an eating utensil corresponding to FIG. 12 with replaceable, but bent handle shafts.

Finally, FIG. 16 shows an embodiment of the eating utensil according to the present invention, which corresponds essentially to the embodiment according to FIG. 8, but in which the two replaceable handle shafts 52,1 and 53/1 have a bent shape. This bent shape of the handle shafts 52/1 and 53/1 may offer a special kind of advantage to one-handed users with motor handicap of the aim and/or hand. It is also possible to use handle shafts of any other desired shape if needed.

The application and the mode of operation of this embodiment shown in FIG. 16 are otherwise the same as in the embodiment according to FIGS. 8 and 9.

While specific embodiments of the invention have been shown and described in detail to illustrate the application of the principles of the invention, it will be understood that the invention may be embodied otherwise without departing from such principles.

What is claimed is:

1. An eating utensil, comprising:

an inner spoon shell part rigidly connected to a first handle shaft;

an outer spoon shell part rigidly connected to a second handle shaft, said outer spoon shell part and said inner spoon shell part cooperating to form a spoon shell separated into said outer spoon shell part and said inner spoon shell part along a ring line;

a hinge connecting said first handle shaft to said second handle shaft at a location adjacent to said spoon shell, said hinge defining a laterally extending pivot axis, said first handle shaft pivoting with respect to said second handle shaft about said pivot axis and said outer spoon shell part pivoting with respect to said inner spoon shell part to move between an open position and a closed position forming said spoon shell, said outer spoon shell part comprising an outer edge ring with an outer spoon shell part cutting edge extending a distance adjacent to said ring line, said inner shell spoon part having an outer edge with an inner spoon shell part cutting edge extending a distance adjacent to said ring line, said outer spoon shell part cutting edge and said inner spoon shell part cutting edge cooperating with portions of said outer spoon shell part cutting edge coming into contact with portions of said inner spoon shell part cutting edge as said outer spoon shell part is moved relative to said inner spoon shell part from said open position to said closed position forming said spoon shell;

a spreading spring arranged between said first handle shaft and said second handle shaft;

a locking device acting on said first handle shaft and said second handle shaft with said outer spoon shell part and said inner spoon shell part in said closed position forming said spoon shell.

2. An eating utensil in accordance with claim 1, wherein said locking device includes a detent pawl arranged at an end of said first handle shaft, the detent pawl including a locking nose and said locking device including a ratchet part arranged on an opposing end section of said second handle shaft.

3. An eating utensil in accordance with claim 1, wherein said locking device comprises a locking bar guided movably on one of said first handle shaft and said second handle shaft, said locking bar extending in a locked position with a locking nose behind a locking edge of the other of said first handle shaft and said second handle shaft.

4. An eating utensil in accordance with claim 1, wherein said locking device includes a locking pin with a locking nose displaceably mounted to one of said first handle shaft and said second handle shaft and a locking shoulder defined by the other one of said first handle shaft and said second handle shaft wherein said locking pin extends behind said locking shoulder to position said locking nose in a locked position.

5. An eating utensil in accordance with claim 1, wherein said locking device has a detent pawl and a spring with said detent pawl positionable to be held in a spring-loaded manner.

6. An eating utensil in accordance with claim 1, wherein said handle shafts each comprise a base part and a disconnectable handle shaft, wherein each disconnectable handle shaft is removable from the respective associated said base part to replace said disconnectable handle shaft with another disconnectable handle shaft of another shape.

7. An eating utensil, comprising:

an inner spoon shell part rigidly connected to a first handle shaft;

an outer spoon shell part rigidly connected to a second handle shaft, said outer spoon shell part and said inner spoon shell part cooperating to form a spoon shell;

a hinge connecting said first handle shaft to said second handle shaft at a location adjacent to said spoon shell, said hinge defining a laterally extending pivot axis, said first handle shaft pivoting with respect to said second handle shaft about said pivot axis and said outer spoon shell part pivoting with respect to said inner spoon shell part to move between an open position and a closed position forming said spoon shell, said outer spoon shell part comprising an outer edge ring with an outer spoon shell part cutting edge with an inner cutting side surface said inner shell spoon part having an outer edge with an inner spoon shell part cutting edge having an outer cutting side surface, said outer spoon shell part cutting edge and said inner spoon shell part cutting edge cooperating with contact between said inner shell part cutting edge and said outer shell part cutting edge progressing from contact between portions of said inner shell part cutting edge and portions of said outer shell part cutting edge adjacent to said pivot axis to contact between portions of said inner shell part cutting edge and portions of said outer shell part cutting edge at a front end of said spoon shell as said outer spoon shell part is moved relative to said inner spoon shell part and said inner cutting side surface is moved relative to said outer cutting side surface from said open position to said closed position, forming said spoon shell;

a spreading spring arranged between said first handle shaft and said second handle shaft;

a locking device acting on said first handle shaft and said second handle shaft with said outer spoon shell part and said inner spoon shell part in said closed position forming said spoon shell.

8. An eating utensil in accordance with claim 7, wherein said locking device includes a detent pawl arranged at an end of said first handle shaft, the detent pawl including a locking nose and said locking device including a ratchet part arranged on an opposing end section of said second handle shaft.

9. An eating utensil in accordance with claim 7, wherein said locking device comprises a locking bar guided movably on one of said first handle shaft and said second handle shaft, said locking bar extending in a locked position with a locking nose behind a locking edge of the other of said first handle shaft and said second handle shaft.

10. An eating utensil in accordance with claim 7, wherein said locking device includes a locking pin with a locking nose displaceably mounted to one of said first handle shaft and said second handle shaft and a locking shoulder defined by the other one of said first handle shaft and said second handle shaft wherein said locking pin extends behind said locking shoulder to position said locking nose in a locked position.

11. An eating utensil in accordance with claim 7, wherein said locking device has a detent pawl and a spring with said detent pawl positionable to be held in a spring-loaded manner.

* * * * *